US008222828B2

(12) United States Patent
Muehlschlegel

(10) Patent No.: US 8,222,828 B2
(45) Date of Patent: Jul. 17, 2012

(54) CIRCUIT ARRANGEMENT FOR IGNITING AND OPERATING A DISCHARGE LAMP

(75) Inventor: Joachim Muehlschlegel, Groebenzell (DE)

(73) Assignee: Osram AG, Munich (DE)

( * ) Notice: Subject to any disclaimer, the term of this patent is extended or adjusted under 35 U.S.C. 154(b) by 308 days.

(21) Appl. No.: 12/596,991

(22) PCT Filed: Apr. 24, 2007

(86) PCT No.: PCT/EP2007/053971

§ 371 (c)(1),
(2), (4) Date: Oct. 22, 2009

(87) PCT Pub. No.: WO2008/128576

PCT Pub. Date: Oct. 30, 2008

(65) Prior Publication Data

US 2010/0117548 A1 May 13, 2010

(51) Int. Cl.
*H05B 37/02* (2006.01)

(52) U.S. Cl. ..... 315/224; 315/247; 315/209 R; 315/276; 315/291

(58) Field of Classification Search ..... 315/247, 315/224, 225, 209 R, 246, 219, 291, 307
See application file for complete search history.

(56) References Cited

U.S. PATENT DOCUMENTS 6,864,645 B2 3/2005 Sun et al.
7,501,889 B2 * 3/2009 Mendenhall ..... 330/251

* cited by examiner

*Primary Examiner* — Tuyet Thi Vo

(57) ABSTRACT

A circuit arrangement for starting and for operating a gas discharge lamp with an AC step-down converter or a half-bridge arrangement, which functions as a step-down inverter during quasi-resonant operation, a lamp inductor and a resonant capacitor, which form a resonant circuit, and a smoothing inductor, wherein the resonant capacitor is dimensioned in terms of its value such that, during normal operation of the lamp, a voltage ripple of over 100 V from maximum to maximum is present across said resonant capacitor, the smoothing inductor being dimensioned in such a way that it can filter the majority of the voltage ripple, and the switching frequency at the same time being between 200 kHz and 500 kHz.

7 Claims, 2 Drawing Sheets

CIRCUIT ARRANGEMENT FOR IGNITING AND OPERATING A DISCHARGE LAMP

RELATED APPLICATIONS

The present application is a national stage entry according to 35 U.S.C. §371 of PCT application No.: PCT/EP2007/053971 filed on Apr. 24, 2007.

BACKGROUND

The invention relates to a circuit arrangement and electronic control gear for starting and operating discharge lamps. Electronic control gear for gas discharge lamps are used increasingly as a result of their advantages in comparison with the conventional ballasts, such as increased light quality, improved luminous efficiency and automatic disconnection of the gas discharge lamps at the end of life. Until now, circuits with a full-bridge which operate the lamp with a type of alternating direct current have primarily been used for high-pressure gas discharge lamps. This is necessary since most high-pressure gas discharge lamps cannot be operated on alternating currents with a higher frequency owing to resonances in the burner vessel. In this case, two principle configurations are distinguished from one another. Firstly, the configuration with a step-down converter with a downstream full bridge, and secondly a full bridge with an integrated step-down converter functionality. For reasons of costs, the latter option has been increasingly used for some time. For starting, a pulse starting device is generally used, for which a further switch for triggering the starting pulse is required. In the case of lamp types which have a comparatively low starting voltage, resonant starting methods are also used.

In this case, a half-bridge branch of the full-bridge with a starting inductor and a starting capacitor with a small capacitance is used for the resonant starting. For the step-down converter stage, which produces the low-frequency square-wave current after starting of the lamp, the second half-bridge branch with the step-down converter inductor and the step-down converter filter capacitor (greater capacitance) is used. The step-down converter stage in this case functions in the favorable intermittent operating mode, which makes zero voltage switching possible.

US2004/183463A1 has disclosed a circuit which operates a gas discharge lamp with a full-bridge, the full-bridge being split into two half-bridge branches which function differently and of which one is operated at a low frequency, whereas the other can also be operated at a high frequency. An LCR resonant circuit, which is excited by the half-bridge branch functioning at a high frequency, is provided for the starting of the gas discharge lamp.

All of these arrangements are very cost-intensive, and therefore in recent times attempts have increasingly been made to replace the cost-intensive full-bridge with a more favorable half-bridge. Said half-bridge uses a small capacitor for operation. The half-bridge in this case runs in the non-intermittent operating mode during step-down operation. In the non-intermittent operating mode, the value of the capacitor capacitance is of little importance for the filtering of the lamp current. A small capacitance which acts as a starting capacitor for the resonant starting is therefore used in this case. The non-intermittent operating mode has the disadvantage, however, that considerably higher switching losses occur and it results in unfavorable dimensioning of the step-down converter inductor (a high inductance is required for the step-down converter inductor, which results in a large physical shape and more losses). A large inductor also requires more space and results in increased costs.

SUMMARY

Various embodiments provide a circuit arrangement and a method for starting and operating a gas discharge lamp which no longer has the abovementioned disadvantages.

The invention is based on the knowledge that a high capacitance for the filtering of the resultant ripple voltage is not necessarily required for the operation of a step-down half-bridge in the intermittent operating mode. It has been shown that, at a relatively high operating frequency of the step-down converter, the ripple voltage can largely be compensated for by an inductance. The residual ripple of the voltage which is present at the gas discharge lamp can no longer have a negative effect since the damping of the gas discharge lamp at a relatively high operating frequency is so high that it smoothes the applied residual ripple itself. Thus, a significantly higher ripple voltage can be applied to said lamp without the life of the gas discharge lamp being negatively influenced.

The high step-down converter frequency has a further positive effect. The smoothing inductor L2 can have a smaller physical shape owing to the high frequency, which saves further costs. Nevertheless, the smoothing inductor L2, owing to the high switching frequency, is capable of smoothing a large proportion of the voltage ripple produced at the resonant capacitor C1, with the result that a voltage ripple which, owing to its high frequency, can easily be processed by the gas discharge lamp is present across the gas discharge lamp despite the insufficient filtering through the capacitor C1.

The capacitor C1 is in this case dimensioned in such a way that it forms, together with the lamp inductor L1, a series resonant circuit, which, upon excitation, produces the starting voltage for the gas discharge lamp.

As a result of the advantageous small capacitance of the capacitor C1, the inductance and therefore the physical shape of the lamp inductor L1 can likewise be kept small, which saves further costs.

In order to start the lamp, the half-bridge is operated at a frequency close to the resonant frequency in order to excite the series resonant circuit including L1 and C1 and to produce a high starting voltage, which is then applied to the lamp 5 via L2. As soon as the lamp has started, the half-bridge is operated on the conventional alternating direct current, with a high drive frequency of the transistors being superimposed in order to implement the step-down converter properties.

BRIEF DESCRIPTION OF THE DRAWING(S)

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

First Embodiment

The following detailed description refers to the accompanying drawings that show, by way of illustration, specific details and embodiments in which the invention may be practiced.

Figure 1:
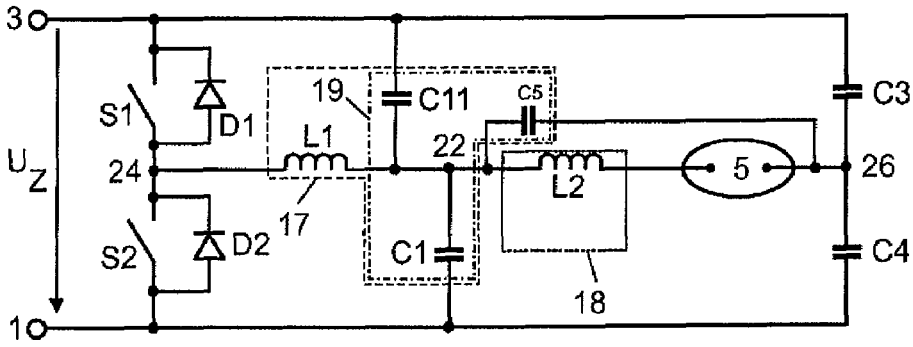
FIG. 1 shows a circuit diagram of the circuit arrangement according to the invention.

FIG. 1 shows the circuit diagram of the circuit arrangement according to the invention in the first embodiment. The intermediate circuit voltage $U_z$ is present between the ground point 1 and the voltage supply 3. It is generally between 380 V and 400 V. The circuit arrangement includes a symmetrical half-bridge, which contains two switches S1 and S2, arranged in series, with the associated coupling capacitors C3 and C4, which are connected to the intermediate circuit voltage. A series circuit including a lamp inductor L1, a smoothing inductor L2 and the gas discharge lamp 5 is connected between the node 24 between the two switches S1 and S2 and the node 26 between the two capacitors C3 and C4. A resonant capacitor C1 is connected to the node 22 between the lamp inductor L1 and the smoothing inductor L2 and is connected at its other end to circuit ground 1. The resonant capacitor C1 forms, together with the lamp inductor L1, the series resonant circuit 17.

In order to start the gas discharge lamp 5, the half-bridge is operated at a frequency which is close to the resonance frequency of the series resonant circuit 17. In this case, a high voltage is built up across the capacitor C1, which thus acts as a starting capacitor. As soon as the lamp has been started and is in the normal operating mode, the half-bridge is operated at a low frequency, which is in the range of from 100 Hz to 1000 Hz. This low frequency is superimposed by a high chopper frequency, which is in the range of from 200 kHz to 500 kHz. This frequency is required for transforming the relatively high intermediate circuit voltage $U_z$ down to the relatively low running voltage of the gas discharge lamp. This superimposed frequency, owing to the low capacitance value of the capacitor C1, results in a high voltage ripple of over 100V from maximum to maximum (i.e. peak-to-peak) across said capacitor. The capacitance value of the capacitor C1 can be determined from the following formula:

$$C1 = C_N * \frac{P_L}{70\ \mathrm{W}}$$

where $P_L$ denotes the rated lamp power. The capacitance $C_N$ can fluctuate in the range between 4 nF and approximately 20 nF. Preferably, the capacitance $C_N$ fluctuates between 4 nF and 10 nF.

Figure 2:
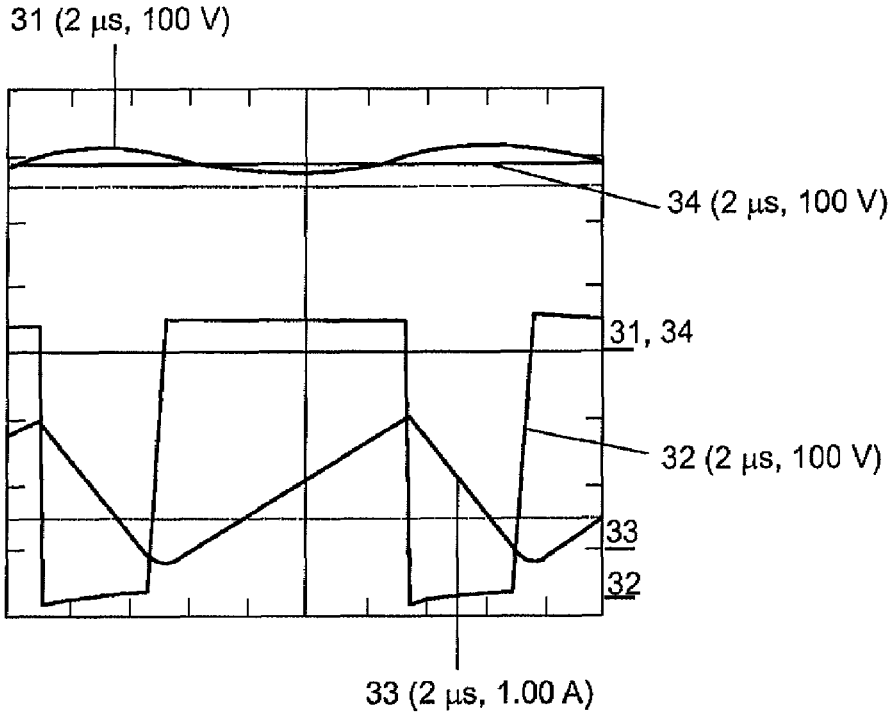
FIG. 2 shows signal profiles of a step-down half-bridge in the non-intermittent operating mode in accordance with the prior art.

In order to represent the difference in the mode of operation of the circuit arrangement according to the invention in relation to the prior art, consideration will be given to FIGS. 2 and 3. FIG. 2 illustrates the signal profiles of a few important signals of a circuit arrangement in accordance with the prior art. This circuit arrangement includes, as has already been indicated at the outset, a half-bridge, which is operated in the non-intermittent mode. As a result, very high switching losses occur here. The circuit per se is in principle very similar to the circuit of the present invention. For non-intermittent operation, a small filter capacitor, as is also used in the present invention, is sufficient. The voltage present across the filter capacitor with the comparatively low voltage ripple is represented by the signal 31. The signal 34 which is at the same level represents the voltage across the lamp. The voltage ripple which is per se already very low is completely compensated for by a filter inductor and the lamp itself. The signal 32 represents the pulse-width-modulated half-bridge voltage at point 24. This results in a current (signal 33) through a step-down converter inductor, which is approximately comparable with the inductor L1 of the present invention. By way of summary it can be stated that the filter capacitor which is already small per se is sufficient for the non-intermittent operating mode in order to produce a qualitatively high-value signal for the gas discharge lamp.

Figure 3:
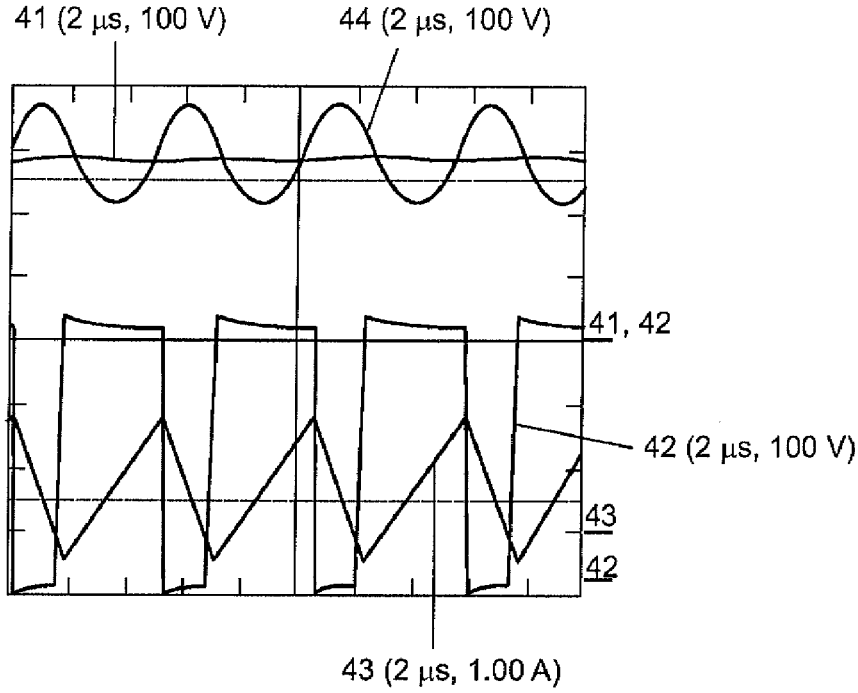
FIG. 3 shows signal profiles of a step-down half-bridge according to the invention in the intermittent operating mode.

FIG. 3 illustrates the same signals for the circuit arrangement according to the invention. The half-bridge is operated at quasi-resonance, which makes virtually zero voltage switching of the switching transistors possible. Quasi-resonant operation in this context means that the inductor current is at the boundary between intermittent and non-intermittent operation. The signal 44 clearly shows the large voltage ripple of over 100V from maximum to maximum across the capacitor C1. The capacitor C1 therefore performs a dual function. During the starting phase, it represents the resonant capacitor and therefore the starting capacitor. As soon as the lamp has been started, the bridge changes to the normal operating mode, and the capacitor C1 now acts as a filter capacitor. The inductor L1 also acts as a resonant inductor during starting and as a lamp inductor during normal operation. The signal 41 represents the voltage across the lamp. A slight ripple can still be identified, but this is not critical for the gas discharge lamp owing to its high frequency. This figure shows the difference from the previously known prior art. The voltage ripple is not compensated for by a filter capacitance, but by the filter inductance L2. The signal 42 again represents the half-bridge center-point voltage, and the signal 43 represents the current through the inductor L1.

In order to keep the losses of the arrangement at high frequencies low, it is necessary to minimize the capacitances involved during the quasi-resonant polarity reversal operation. These capacitances include the switch capacitances (in the case of MOSFETs these are the drain-source capacitances) the trapezoidal capacitances which are additionally arranged over the switches and the parasitic capacitance of the resonant inductor. The capacitances involved in the polarity reversal operation are also referred to as the effective half-bridge center-point capacitance. This center-point capacitance should be as small as possible. For this purpose, it is necessary to keep the individual capacitances involved low. This can take place by corresponding switching transistors as well as by a low-capacitance coil structure of the resonant inductor L1. The trapezoidal capacitors should also be dimensioned to be as low in value as possible.

The effective half-bridge center-point capacitance should satisfy the following in equation in order to ensure optimum operation:

$$C < L_1 * \frac{I_1^2}{U_Z^2}.$$

The parameter $I_1$ should be in a range of between $0.4*I_N$ and $0.6*I_N$, where $I_N$ is the rated current of the gas discharge lamp.

Second Embodiment

Figure 4:
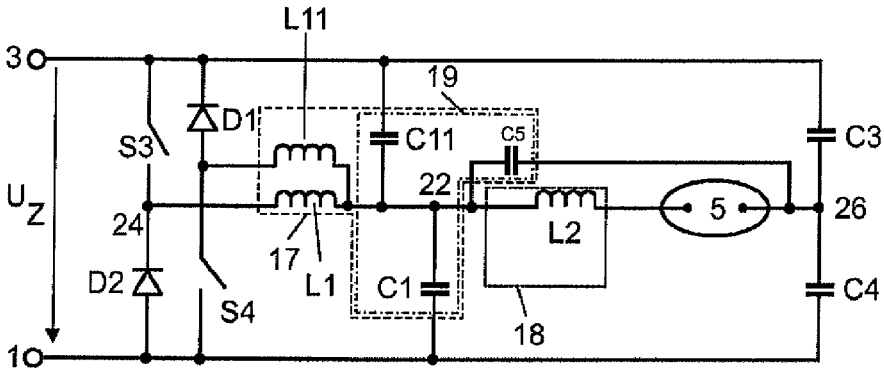
FIG. 4 shows a circuit diagram of the circuit arrangement according to the invention of the second embodiment.

The second embodiment shown in FIG. 4 is similar to the first embodiment. For this reason, only the differences from the first embodiment are illustrated.

In the second embodiment, an arrangement in which two step-down converters are connected in parallel is used instead of the conventional half-bridge arrangement. This arrangement is also referred to as an alternating step-down converter. The first step-down converter is active in the case of a positive lamp current, whereas the second step-down converter is active in the case of a negative lamp current. The step-down converters include a series circuit including a switching element (S3, S4) and a diode (D1, D2). A step-down converter inductor (L1, L11) is connected with its first end to the node between the switch and the diode. The second end of the step-down converter inductor is connected to a resonant capacitor 19, which includes at least one of the capacitances C1 and/or C11 and/or C5.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A circuit arrangement for starting and for operating a gas discharge lamp comprising an AC step-down converter or a half-bridge arrangement, which functions as a step-down inverter during quasi-resonant operation, a lamp inductor and a resonant capacitor, which form a resonant circuit, and a smoothing inductor, wherein the resonant capacitor is dimensioned in terms of its value such that, during normal operation of the lamp, a voltage ripple of over 100 V from maximum to maximum is present across said resonant capacitor, the smoothing inductor being dimensioned in such a way that it can filter the majority of the voltage ripple, and the switching frequency at the same time being between 200 kHz and 500 kHz.

2. The circuit arrangement as claimed in claim 1, wherein the switching frequency is between 300 kHz and 450 kHz.

3. The circuit arrangement for starting and for operating a gas discharge lamp as claimed in claim 1, wherein the half-bridge arrangement is implemented using field-effect transistors.

4. The circuit arrangement for starting and for operating a gas discharge lamp as claimed in claim 3, wherein the effective half-bridge center-point capacitance has a value of $$C < L_1 * \frac{I_1^2}{U_Z^2},$$

where $I_1=0.6*I_N$, and $I_N$ is the rated current of the gas discharge lamp.

5. The circuit arrangement for starting and for operating a gas discharge lamp as claimed in claim 3, wherein the effective half-bridge center-point capacitance has a value of $$C < L_1 * \frac{I_1^2}{U_Z^2},$$

where $I_1=0.4*I_N$, and $I_N$ is the rated current of the gas discharge lamp.

6. The circuit arrangement for starting and for operating a gas discharge lamp as claimed in claim 1, wherein the capacitance of the resonant capacitor C1 is calculated from $$C < L_1 * \frac{I_1^2}{U_Z^2},$$

where $P_L$ is the rated power of the gas discharge lamp, and $C_N$ is in the range of between 3 F and 12 F.

7. A method for starting and for operating a gas discharge lamp comprising a half-bridge arrangement, which functions as a step-down inverter, a lamp inductor and a resonant capacitor, which form a resonant circuit, and a smoothing inductor, wherein, in order to start the gas discharge lamp, the half-bridge arrangement is operated at a frequency which is close to the resonant frequency of the resonant circuit, and after starting of the gas discharge lamp, the bridge converts to a low-frequency operating mode, the half-bridge being superimposed by radio frequency driving, which is selected in terms of its frequency such that a high-voltage ripple of over 100 V from maximum to maximum which is present at the resonant capacitor is largely compensated for by the smoothing inductor with the switching frequency at the same time being between 200 kHz and 500 kHz.

* * * * *

UNITED STATES PATENT AND TRADEMARK OFFICE

CERTIFICATE OF CORRECTION

PATENT NO. : 8,222,828 B2
APPLICATION NO. : 12/596991
DATED : July 17, 2012
INVENTOR(S) : Joachim Muehlschlegel It is certified that error appears in the above-identified patent and that said Letters Patent is hereby corrected as shown below:

Column 6, line 37, delete “high”

Signed and Sealed this
Twenty-third Day of October, 2012

David J. Kappos

David J. Kappos
*Director of the United States Patent and Trademark Office*